US009970279B2

(12) United States Patent
Naedler

(10) Patent No.: US 9,970,279 B2
(45) Date of Patent: May 15, 2018

(54) APPARATUS AND METHODS FOR INHIBITING A SCREEN-OUT CONDITION IN A SUBTERRANEAN WELL FRACTURING OPERATION

(71) Applicant: UTEX Industries, Inc., Houston, TX (US)

(72) Inventor: Mark Henry Naedler, Cypress, TX (US)

(73) Assignee: UTEX Industries, Inc., Houston, TX (US)

( * ) Notice: Subject to any disclaimer, the term of this patent is extended or adjusted under 35 U.S.C. 154(b) by 723 days.

(21) Appl. No.: 14/025,388

(22) Filed: Sep. 12, 2013

(65) Prior Publication Data

US 2015/0068762 A1 Mar. 12, 2015

(51) Int. Cl.
*E21B 34/14* (2006.01)
*E21B 43/267* (2006.01)

(52) U.S. Cl.
CPC ..... *E21B 43/267* (2013.01); *E21B 34/14* (2013.01)

(58) Field of Classification Search
CPC ..... E21B 2034/007; E21B 34/14; E21B 43/26
See application file for complete search history.

(56) References Cited

U.S. PATENT DOCUMENTS 5,579,844 A 12/1996 Rebardi et al.
7,108,067 B2 9/2006 Themig et al.
7,866,397 B2 1/2011 Lee
2003/0127227 A1* 7/2003 Fehr ..... E21B 33/124 166/306
2007/0017675 A1* 1/2007 Hammami ..... E21B 43/086 166/278
2012/0043093 A1* 2/2012 Cravatte ..... E21B 21/103 166/376

(Continued)

OTHER PUBLICATIONS

"Modulus of Rigidity." www.engineeringtoolbox.com, Retrieved Feb. 28, 2017.*

(Continued)

*Primary Examiner* — Robert E Fuller
*Assistant Examiner* — Steven A MacDonald
(74) *Attorney, Agent, or Firm* — Haynes and Boone, LLP

(57) ABSTRACT

A subterranean well fracturing system comprises a downhole well string having installed therein initially closed upstream and downstream sliding sleeve valve assemblies each openable to provide fracing fluid discharge outlets through well string side ports to an associated subterranean fracing zone. To inhibit an undesirable screen-out condition during formation fracturing, specially designed apparatus and methods are operative to sequentially (1) block the downstream valve seat, (2) open the blocked downstream valve seat using pressurized fracing fluid, (3) partially block the upstream valve seat, (4) open the partially blocked upstream valve seat using pressurized fracing fluid, a portion of which is flowed through the partially blocked upstream valve seat, and then (5) unblock the partially blocked upstream valve seat to permit a full flow of pressurized fracing fluid therethrough. In this manner, pressurized fracing fluid is simultaneously delivered to two fracing zones to inhibit a screen-out condition in the well string.

15 Claims, 6 Drawing Sheets

(56) References Cited

U.S. PATENT DOCUMENTS

| | | | | |
|---|---|---|---|---|
| 2012/0217021 | A1* | 8/2012 | Cravatte | E21B 34/14<br>166/373 |
| 2014/0166912 | A1* | 6/2014 | Larisey | E21B 43/26<br>251/61 |
| 2014/0246209 | A1* | 9/2014 | Themig | E21B 43/14<br>166/374 |

OTHER PUBLICATIONS

Canadian Office Action for Patent Application No. 2,861,805 dated Nov. 26, 2015, 4 pages.

* cited by examiner

APPARATUS AND METHODS FOR INHIBITING A SCREEN-OUT CONDITION IN A SUBTERRANEAN WELL FRACTURING OPERATION

BACKGROUND

The present invention generally relates to the stimulation of subterranean wells and, in a representatively illustrated embodiment thereof, more particularly relates to specially designed apparatus and methods for inhibiting a screen-out condition in a subterranean well fracturing operation.

In zone fracturing of subterranean wells one previously proposed method employs a series of tubular sleeves longitudinally spaced apart along a tubular casing of an overall wellbore string. Each sleeve is slidable relative to the casing between a closed position in which the sleeve blocks associated casing side wall ports, and an open position in which the sleeve unblocks such ports to permit exit therethrough of a pressurized fracing slurry which is used to create and prop open subterranean formation fractures through which production fluid may be subsequently delivered through the wellbore string to the surface for recovery. Annular seats are secured to the sliding sleeves for movement therewith relative to the casing and are sized to sealingly receive valve actuating members, such as balls, which are successively dropped through the string. Via the use of packers or other types of seal-off structures interdigitated with the sliding sleeves, a series of fracturing zones are defined externally of the casing—each zone being associated with one of the sliding sleeves.

In carrying out a typical zone fracturing operation, with the sleeves initially in their closed positions, a ball or other type of valve actuating member is dropped through the string and caused to sealingly engage the seat portion of the lowermost sleeve. Via downward fluid pressure exerted on the dropped ball, its associated sleeve is forced in a downstream direction to its open position in which its previously covered casing ports are opened to permit pressurized frac slurry to be discharged into the formation adjacent the now-opened set of casing ports. When the fracing of this first zone is complete, a second ball is dropped into sealing engagement with the seat of the closed sliding sleeve immediately uphole of the opened first sleeve. Downward fluid pressure is then exerted on the second ball to downwardly slide its sliding sleeve and thereby open a second series of casing ports to permit pressurized fracing fluid to flow outwardly therethrough to thereby frac a second formation zone above the first fraced formation zone while the second ball isolates the fracing fluid from the first dropped ball. This sequence is repeated for each of the upwardly successive closed sliding sleeves until the zone fracturing operation is completed.

When fracing a well it is desirable to pack as much proppant into a formation as possible to keep the fractures open for production, especially close to the wellbore. A risk exists for plugging a well by packing too much proppant into a specific zone. This plugging is commonly known as a "screen-out" which may be defined as a condition arising when fracture fluids are no longer capable of carrying the proppant or the concentration of proppant becomes too great, causing the proppant to settle out in the piping and not be carried into the subterranean fractures.

A screen-out condition may cause a severe disruption in well operations and significant cost overruns due to the well known difficulties encountered in eliminating the screen-out. Various techniques have been previously proposed to prevent a screen-out condition from occurring since unplugging a screen-out is quite time consuming and expensive. Each of these known techniques carries with it problems which makes it less than entirely desirable. As but one example, a common screen-out prevention method when initiating fractures upon opening a new zone is to send fluid with no proppant therein to the formation for a period of time, and later add maximum concentrations of proppant to the fluid to place the proppant into the subterranean fractures. Due to the cost of the fluid it is desirable to minimize its use in the fracing operation. This known technique, however, substantially increases the volume of fracing fluid required, thereby materially increasing the overall cost and time needed for the fracing operation.

As can be seen from the foregoing, a need exists for improved apparatus and methods which eliminate or at least reduce the aforementioned problems created by the occurrence of screen-out conditions in well fracing operations as generally described above. It is to this need that the present invention is primarily directed.

DETAILED DESCRIPTION

Figure 1:
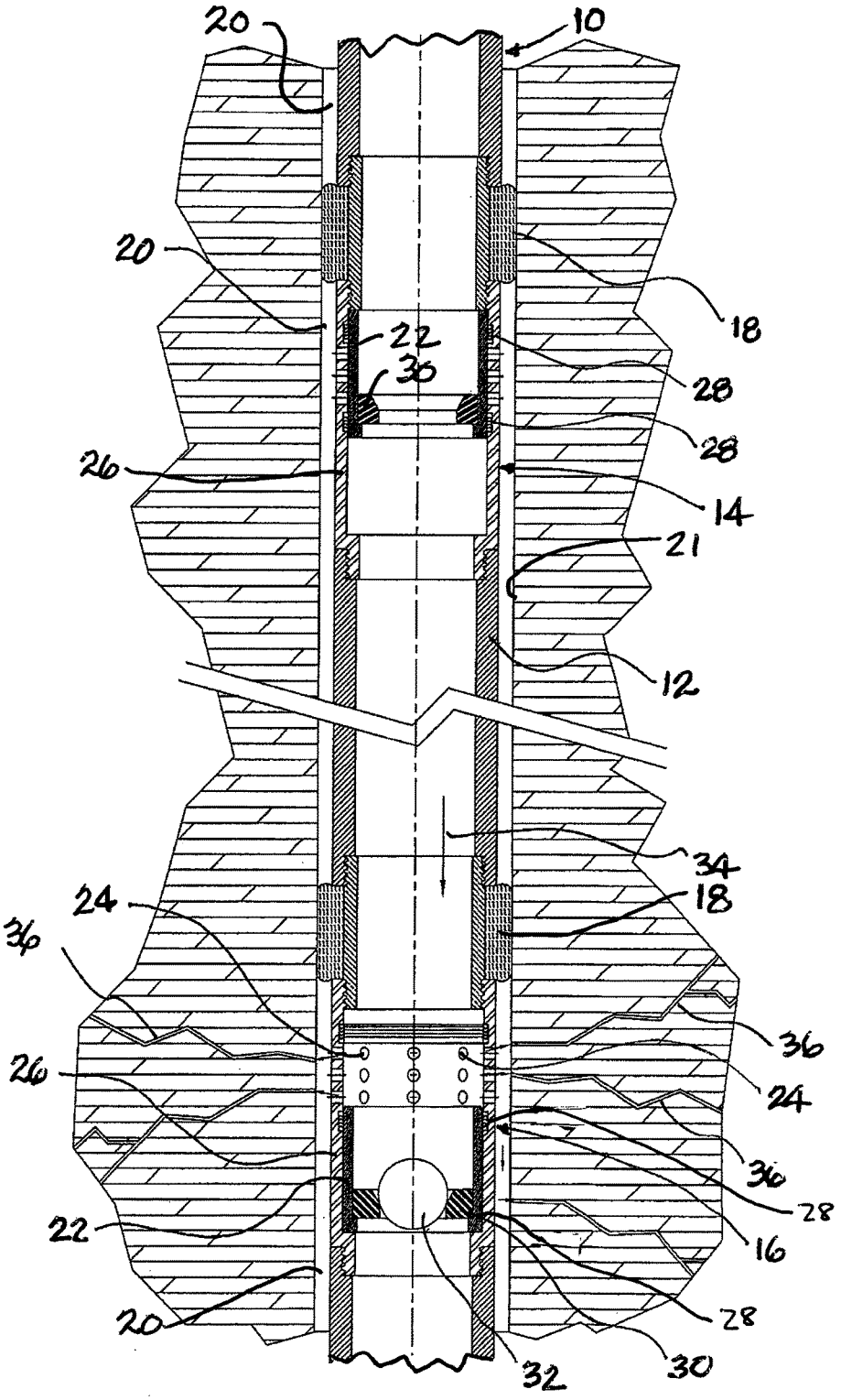
FIG. 1 is a cross-sectional view through a longitudinal portion of a deployed wellbore string with a sliding sleeve assembly therein opened to permit the fracturing of a subterranean formation zone adjacent the opened sliding sleeve assembly.
Figure 2:
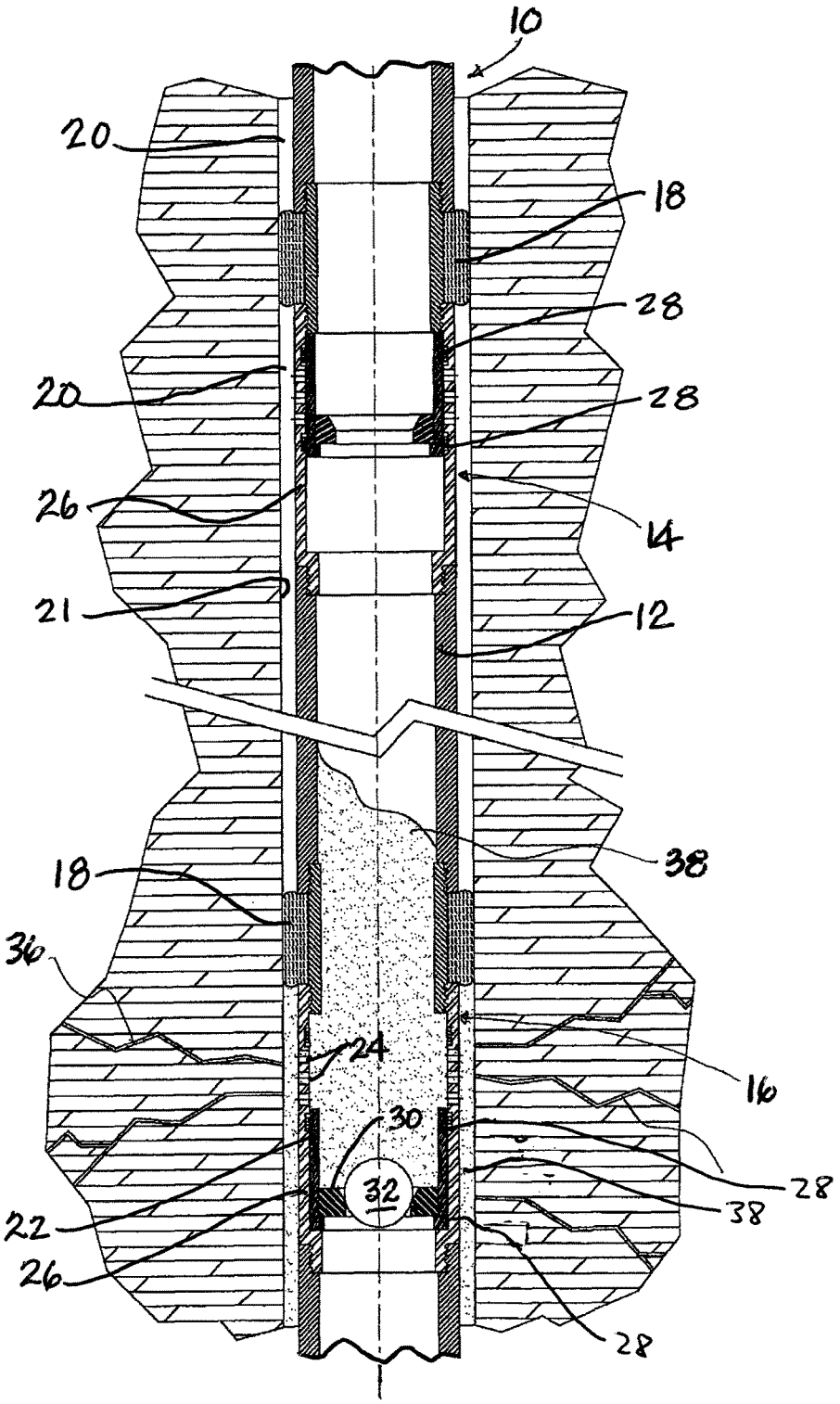
FIG. 2 is a view similar to that in FIG. 1, but with an undesirable screen-out condition having been created within the wellbore string above the opened sliding sleeve assembly.

Referring initially to FIGS. 1 and 2, a longitudinal portion of a downhole-deployed wellbore string 10 is shown which comprises a tubular casing 12 in which a longitudinally spaced apart series of sliding sleeve valve assemblies, including a representative uphole or upstream sleeve valve assembly 14 and a downhole or downstream sleeve valve assembly 16 below it. Packing elements 18, or some other structures such as cement sections, prevent fluid flow between annular zones 20 disposed between the exterior of the wellbore string 10 and the borehole 21 through which the string 10 extends.

Each sliding sleeve valve assembly 14,16 comprises a coaxial tube 22 that can be positioned over radial holes or ports 24 in an exterior tubing component 26 of the sliding sleeve valve assembly. Sealing structures such as O-rings 28 prevent fluid passage from the interior of the wellbore string 10 to the annular zones 20. Each sliding sleeve valve assembly 14,16 may also have a structure, such as a seat 30 that can be engaged by a valve actuating member, representatively in the form of a ball 32, to actuate the associated coaxial tube 22. Most commonly, seats are designed to be engaged by balls of increasing size to selectively open zones with specific ball sizes. The present invention applies to, but is not limited to, systems with ascending ball sizes. Sliding sleeve systems utilizing expandable seats (as opposed to the representatively fixed diameter seats 30) can also benefit from principles of the present invention.

FIG. 1 shows the wellbore string with fracing fluid passing therethrough in the downstream direction 34 to the open downstream sliding sleeve assembly 16, the fracing fluid comprising a fluid laden with proppant such as sand. The fluid is directed through the opened radial ports 24 of the downstream sliding sleeve valve assembly 16 and into adjacent subterranean formation fractures 36 in the earth. It is desirable to lodge as much proppant as possible in these fractures to allow hydrocarbons to later be able to pass through the fractures 36 for delivery to the surface for recovery. It is also desirable to minimize the use of fluid when delivering the proppant due to the cost of the fluid.

FIG. 2, in which principles of the present invention are not utilized, illustrates the wellbore string 10 in a screen-out condition in which proppant 38 has become too dense and impacted within the string 10 to allow fluid to flow to the fractures 36. The most common time for this screen-out condition to occur is at the point when fractures 36 can no longer accept any more proppant 38. Another point at which a screen-out condition can occur is when the sliding sleeve assembly 16 is initially opened and fractures 36 have not yet been initiated. A current practice employed to prevent a screen-out condition is to send fluid without proppant therein to the formation for a period of time, and thereafter add proppant to the fluid once the fractures 36 have been created. As previously mentioned herein, this technique is often less than satisfactory due to increased cost and time delay considerations. In a screen-out condition such as that depicted in FIG. 2, it is not possible to flow a ball down the string 10 and open the upstream sliding sleeve valve assembly 14 since fluid cannot be pumped downwardly through the string 10 due to the proppant-blocked screen-out condition shown in FIG. 2.

Figure 3:
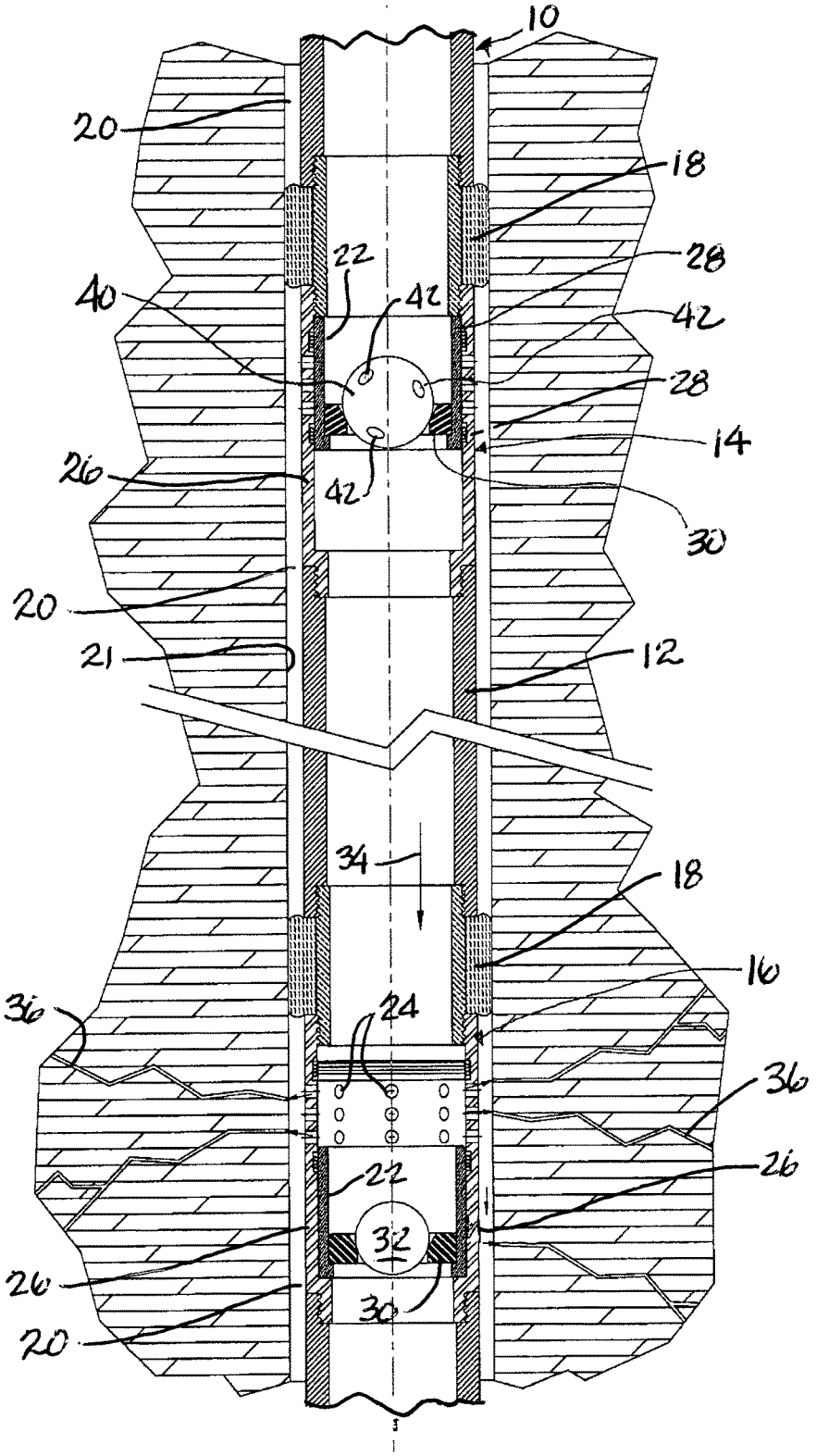
FIGS. 3-5 are cross-sectional views through the deployed wellbore string portion and sequentially depict the representative use of improved apparatus and methods of the present invention in inhibiting in the wellbore string portion the creation of the screen-out condition shown in FIG. 2.
Figure 4:
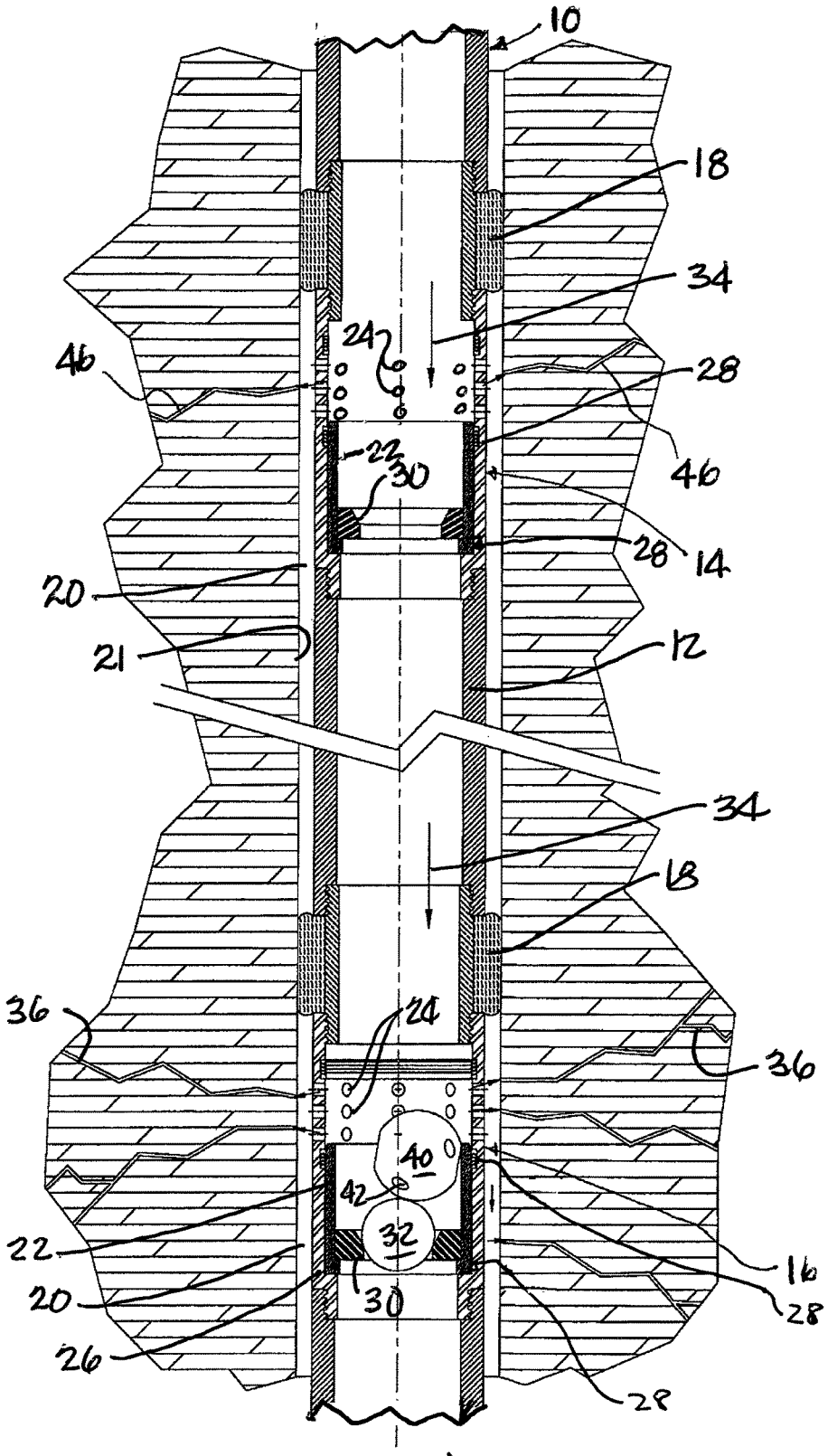
Figure 5:
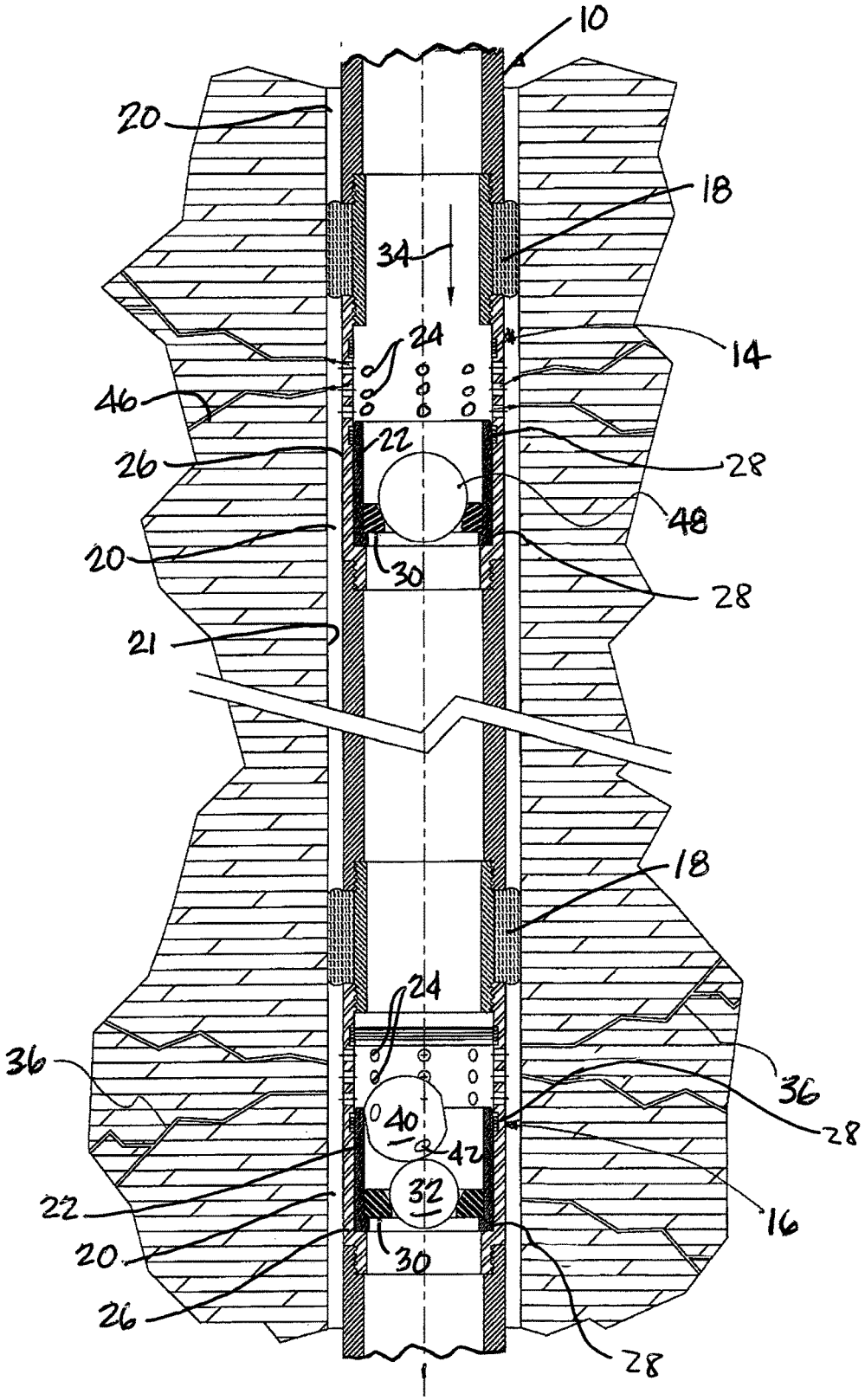
Figure 6:
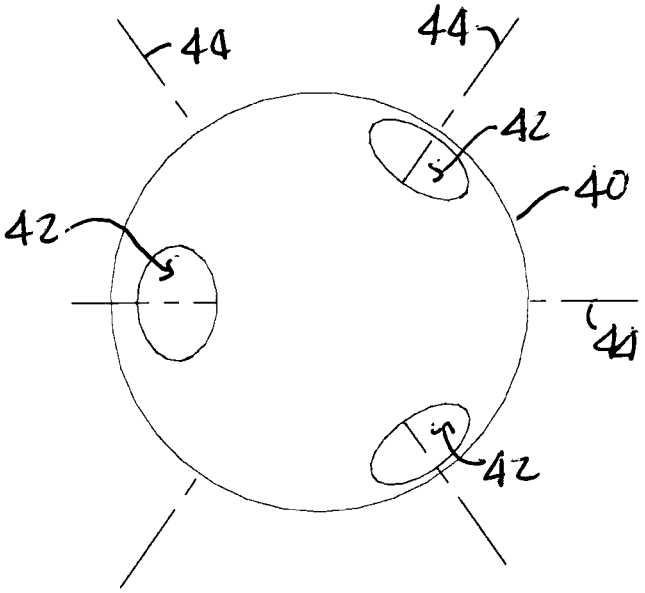
FIG. 6 is an enlarged perspective view of a specially designed valve actuating member embodying principles of the present invention and used in the screen-out inhibiting technique shown in FIGS. 3-5.

FIGS. 3-5 sequentially illustrate the representative use of improved apparatus and methods of the present invention in preventing in the depicted portion of the wellbore string 10 the screen-out condition shown in FIG. 2. With initial reference to FIG. 3, there is illustrated therein a specially designed valve actuating structure used to create a pressure differential across the seat of the upstream sliding sleeve valve assembly 14. By way of non-limiting example, the valve actuating structure is a second ball 40 (see also FIG. 6) with through-holes 42 (representatively three in number) suitably formed therein and extending along axes 44 so that the ball 40, when seated on the upstream seat 30, is not capable of completely plugging fluid flow therethrough to the downstream sliding sleeve valve assembly 16. The valve actuating ball structure 40 could also function in this method without holes. However, the ability of the ball 40 to pass fluid is desired. In FIG. 3, ball 40 which is being downwardly forced through the string 10 by pressurized fracing fluid is shown at a point at which the ball 40 initially lands on the upstream seat 30, but has not yet opened the upstream sliding sleeve assembly 14.

As will be appreciated by those of ordinary skill in this particular art, the dropping of the ball 40 takes place after the lower ball 32 has been dropped onto and blocks the downstream seat 30 which is then downwardly shifted by pressurized fracing fluid to open the downstream sliding sleeve valve assembly 16 and create the fractures 36 via pressurized fracing fluid outflow through the uncovered tubing string side wall ports 24 of the downstream sliding valve assembly 16.

The ball 40 is made of a suitable material hard enough to actuate the coaxial tube 22 of the upstream sliding sleeve assembly 14. Upstream coaxial tube 22 (like the downstream coaxial tube 22) is representatively held in its closed position by means of shear pins or a shear ring (neither of which is illustrated herein). Upstream and downstream sliding sleeve valve assemblies 14,16 are designed to open at a pressure much lower than the pressure at which the formation is fraced. The ball 40 is strong enough to stay supported in the upstream seat 30 and open the upstream sliding sleeve valve assembly 14, but is not strong enough to remain in the upstream seat 30 at the fracing pressure.

Ball 40 can have a soft enough modulus to either extrude or shear through the upstream seat 30. A suitable dissolving material may also be utilized in the construction of the ball 40 since a dissolving material used in downhole force-receiving structures are typically suitable for opening of the upstream sliding sleeve valve assembly 14, but do not require future milling in the well. When in place upon the upstream seat 30, the ball 40 only partially blocks the upstream seat 30, thereby permitting a limited fluid flow downwardly through the upstream seat 30 and creating a downward pressure drop across the upstream seat 30 sufficient to downwardly open the upstream sliding sleeve valve assembly 14. After the upstream sliding sleeve valve assembly 14 is opened, the ball 40 shears downwardly through the upstream seat 30 and arrives at its FIG. 4 position. The ball 40 is initially dropped onto the upstream seat 30 during a final period of the fracing of the downstream subterranean formation zone associated with the downstream sliding sleeve assembly 16. Representatively, the fracing fluid pressure is lowered somewhat during the dropping of the ball 40, and then returned to its full fracing pressure after the ball 40 lands on the upstream seat 30.

FIG. 4 shows the well bore string 10 after the second ball 40 has downwardly moved the upstream tube 22 to its open position and then sheared downwardly through the upstream seat 30. At this point the downstream sliding sleeve valve assembly 16 can still receive proppant concurrently with the upstream sliding sleeve assembly 14. Since the proppant 38 is denser than its carrier fluid, most of the proppant will pass by the upstream sliding sleeve valve assembly 14 to the downstream sliding sleeve assembly 16 which is desirable at the end of a zone's fracture. This also works to the advantage of the upstream sliding sleeve assembly 14 since a low concentration of proppant will be present as initial fractures 46 are made adjacent the upstream sliding sleeve assembly 14.

FIG. 5 depicts the final step in the illustrated representative embodiment of the present invention. A ball 48 (of an imperforate construction like that of the downstream ball 32) is sent down the string 10 to plug fluid flow to the downstream sliding sleeve assembly 16 via the upstream seat 30 by landing on and sealingly blocking the upstream seat 30. Even if the fractures 36 can no longer accept proppant 38, the ball 48 can still land on the upstream seat 30 to concentrate the fracing fluid to the zone at the upstream sliding sleeve assembly 14. The method can subsequently continue with a further ball (not shown) opening yet another zone upstream of the open upstream sliding sleeve valve assembly 14.

As can be readily seen from the foregoing, principles of the present invention may be utilized to reduce the risk of a screen-out condition during the initiation of a new zone and improves the amount of proppant close to the wellbore of a completed zone by dropping an intermediate plugging member (such as the illustrated perforated ball 40) to open the sliding sleeve valve assembly for a new zone while still allowing fracing fluid flow to the nearly completed zone. This uniquely allows two zones to be open for a period of time before dropping a ball to plug fluid from reaching the completed zone and diverting the flow through the most recently opened sliding sleeve assembly. During the period in which both zones are opened, a heavier amount of proppant-laden fluid can be pumped so that a high concentration of proppant surrounds the well bore when the ball serving as a plug closes the completed zone. Having a second zone opened at the time of initiating new fractures in the newly opened sliding sleeve valve assembly's zone also gives time for fractures to form and reduces the risk of a screen-out condition occurring during the initial fracturing stage.

Principles of the present invention are suitable for use in all sliding sleeve valve applications that are actuated by drop systems, usually utilizing but not exclusive to ball-type plug members. Such principles of the present invention may also be utilized to advantage in both cemented and open-hole applications, with open-hole applications being defined herein as sleeves being partitioned by packing elements (as illustratively depicted in FIGS. 3-5 in which principles of the present invention are utilized). The representatively described screen-out inhibiting process applies to both graduated size ball systems and to systems with seats capable of locking. In the case of locking seat-based systems, the ball sent to actuate the upper sliding sleeve valve assembly (for example, the ball 40 used to open the upstream sliding sleeve valve assembly 14) can be of a significantly smaller diameter than the lower ball (for example, the ball 32) while still being capable of actuating its associated seat and then passing therethrough at a pressure less than the full fracing pressure.

The foregoing detailed description is to be clearly understood as being given by way of illustration and example only, the spirit and scope of the present invention being limited solely by the appended claims.

What is claimed is:

1. Apparatus for inhibiting the creation of a screen-out condition in a subterranean well fracturing operation utilizing a downhole tubular well string having, on a sliding sleeve valve assembly installed therein, an upper and a lower movable seat longitudinally shiftable between open and closed orientations within the well string, the upper and lower movable seats having an opening through which pressurized fracing fluid may be flowed, said apparatus comprising:

a first valve actuating member being droppable through the tubular well string onto the lower movable seat in its closed orientation and being constructed and configured to thereafter sequentially:

(1) block the lower movable seat opening in a manner preventing a flow of fracing fluid therethrough, (2) cause the pressurized fracing fluid to slide the lower movable seat to its open orientation; and a second valve actuating member being droppable through the tubular well string onto the upper movable seat in its closed orientation, wherein the second valve actuating member has at least one through-hole formed therein between two spaced apart external surface portions thereof, the second valve actuating member being constructed and configured to thereafter sequentially:

(1) partially block the upper movable seat opening in a manner permitting a limited flow of pressurized fracing fluid therethrough, such that the limited flow passes through the at least one through-hole, such that a first pressure at the upper movable seat is higher than a second pressure at the lower movable seat, (2) cause the pressurized fracing fluid to slide the upper movable seat to its open orientation, and then (3) shear material from an outer surface of the second valve actuating member or extrude the second valve actuating member to change a cross-sectional width of the second valve actuating member as the second valve actuating member passes through the upper movable seat opening to unblock the upper movable seat opening.

2. The apparatus of claim 1 wherein:

said first valve actuating member is a ball.

3. The apparatus of claim 1 wherein:

said at least one through-hole is a plurality of through-holes.

4. The apparatus of claim 1 wherein:

said second valve actuating member is formed from a dissolvable material.

5. An apparatus for inhibiting the creation of a screen-out condition in a subterranean well fracturing operation utilizing a downhole tubular well string comprising:

a first sliding sleeve valve assembly comprising a longitudinally lower movable seat displaceable between open and closed orientations within the well string, the lower movable seat having only a single opening through which pressurized fracing fluid may be flowed; and a first imperforate ball valve actuating member being droppable through the tubular well string onto the lower movable seat in its closed orientation, the first imperforate ball valve actuating member being constructed and configured to thereafter sequentially:

(1) block the lower movable seat opening, (2) cause the pressurized fracing fluid to slide the lower movable seat to its open orientation; and a second perforate ball valve actuating member being droppable through the tubular well string onto an upper movable seat in its closed orientation, wherein the second perforate ball valve actuating member has at least one through-hole formed therein between two spaced apart external surface portions thereof, the second perforate ball valve actuating member being constructed and configured to thereafter sequentially:

(1) partially block the upper movable seat opening in a manner permitting a limited flow of pressurized fracing fluid through the second perforate ball valve actuating member, such that the limited flow passes through the at least one through-hole, (2) cause the pressurized fracing fluid to slide the upper movable seat to its open orientation, and then (3) shear or extrude while passing through the upper movable seat opening to unblock the movable seat in a manner that removes material from opposing exterior sides and reduces a diameter of the second perforate ball valve actuating member.

6. The apparatus of claim 5 wherein:

said at least one through-hole is a plurality of through-holes.

7. The apparatus of claim 5 wherein:

said second perforate ball valve actuating member is formed from a dissolvable material.

8. Apparatus for inhibiting the creation of a screen-out condition in a subterranean well fracturing operation utilizing a downhole tubular well string having, on upper and lower sliding valve assemblies installed therein, a plurality of movable seats comprising a lower movable seat and an upper movable seat, the movable seats longitudinally shiftable between open and closed orientations within the well string, each movable seat having an opening through which pressurized fracing fluid may be flowed, said apparatus comprising:

a first imperforate valve actuating member being droppable through the tubular well string onto the lower movable seat in its closed orientation and being constructed and configured to thereafter sequentially:

(1) block the lower movable seat opening in a manner preventing a flow of fracing fluid therethrough, (2) cause the pressurized fracing fluid to slide the lower movable seat to its open orientation;

a second perforate valve actuating member being droppable through the tubular well string onto the upper movable seat in its closed orientation wherein the second perforate valve actuating member has at least one through-hole formed therein between two spaced apart external surface portions thereof, the second perforate valve actuating member being constructed and configured to thereafter sequentially:

(1) partially block the upper movable seat opening in a manner permitting a limited flow of pressurized fracing fluid therethrough, such that the limited flow passes through the at least one through-hole, (2) cause the pressurized fracing fluid to slide the upper movable seat to its open orientation, and then (3) shear to remove material from an outer surface of the second perforate valve actuating member while passing through the upper movable seat opening to unblock the upper movable seat;

(4) contact the first imperforate valve actuating member and add weight to keep the lower movable seat in its open orientation; and a third imperforate valve actuating member being droppable through the tubular well string onto the upper movable seat in its open orientation and being constructed and configured to thereafter:

(1) block the upper seat opening in a manner preventing a flow of fracing fluid therethrough.

9. The apparatus of claim 8 wherein:

said first imperforate, said second perforate, and said third imperforate valve actuating members are balls.

10. The apparatus of claim 8 wherein:

said at least one through-hole is a plurality of through-holes.

11. The apparatus of claim 8 wherein:

said second perforate valve actuating member is formed from a dissolvable material.

12. The apparatus of claim 8 wherein:

said first imperforate valve actuating member is smaller than said third imperforate valve actuating member.

13. The apparatus of claim 8 wherein:

said first imperforate valve actuating member is smaller than said second perforate valve actuating member.

14. The apparatus of claim 8 wherein the upper sliding valve assembly and the lower sliding valve assembly have only a single opening therethrough.

15. The apparatus of claim 8 wherein the second perforate valve actuating member is a ball configured to shear off opposing sides of the ball when passing through the movable seat under high-pressure in a manner that changes a cross-sectional width of the ball.

* * * * *